US008267295B2

(12) United States Patent
Wu et al.

(10) Patent No.: US 8,267,295 B2
(45) Date of Patent: Sep. 18, 2012

(54) COMBUSTION POWERED NAIL GUN HAVING SAFETY MECHANISM

(75) Inventors: Jian-Rung Wu, Taichung (TW); Ting Huang, Taichung (TW); Chien-Kuo Po, Taichung (TW); Tsung-Min Hsu, Taichung (TW)

(73) Assignee: Basso Industry Corp., Taichung (TW)

( * ) Notice: Subject to any disclaimer, the term of this patent is extended or adjusted under 35 U.S.C. 154(b) by 339 days.

(21) Appl. No.: 12/656,801

(22) Filed: Feb. 17, 2010

(65) Prior Publication Data

US 2010/0206933 A1 Aug. 19, 2010

(30) Foreign Application Priority Data

Feb. 17, 2009 (TW) ..... 98105042 A

(51) Int. Cl.
*B25C 1/08* (2006.01)

(52) U.S. Cl. ..... 227/8

(58) Field of Classification Search ..... 227/8, 9, 227/120

See application file for complete search history.

(56) References Cited

U.S. PATENT DOCUMENTS

| | | | | |
|---|---|---|---|---|
| 5,213,247 | A * | 5/1993 | Gschwend et al. | 227/10 |
| 7,175,063 | B2 * | 2/2007 | Osuga et al. | 227/8 |
| 2009/0236387 | A1 * | 9/2009 | Simonelli et al. | 227/8 |

* cited by examiner

*Primary Examiner* — Brian D Nash
(74) *Attorney, Agent, or Firm* — Bacon & Thomas, PLLC

(57) ABSTRACT

A combustion powered nail gun includes a combustion sleeve moveable between a sealed position and an open position; a trigger switch having a first hook portion; a safety lever pivotally mounted in a housing and provided with a second hook biasable to be engaged with the first hook portion; and a restriction member connected to and moveable along with the combustion sleeve in a way that when the combustion sleeve is in the open position, the restriction member is stopped at the safety lever in which the second hook portion is engaged with the first hook portion so as to lock the trigger switch, and when the combustion sleeve is in the sealed position, the restriction member is spaced away from the safety lever to enable the second hook portion to be biasable away from the first hook portion so as to unlock the trigger switch.

8 Claims, 13 Drawing Sheets

COMBUSTION POWERED NAIL GUN HAVING SAFETY MECHANISM

BACKGROUND OF THE INVENTION

1. Field of the Invention

The present invention relates generally to tools for driving fasteners, such as nails, into workpieces and more particularly, to combustion powered nail guns, referred also to as "combustion nailer", having a safety mechanism.

2. Description of the Related Art

Depending on the power source, nail guns can be separated into an electricity powered type and a combustion powered type. No matter what type of the power source the nail gun uses, the nail gun is generally equipped with a driving unit, which is activated when the user presses the trigger switch, for driving nails one by one out of the nail gun. In addition, in order to prevent an accident firing of the nail due to an unintentional pressing of the trigger switch, the nail gun is always equipped with a safety mechanism for protecting the user. There are many researches about this safety issue already. However, it is still desired to have an improved safety mechanism for the combustion powered nail gun, which is simple in structure and safe in use.

SUMMARY OF THE INVENTION

The present invention has been accomplished in view of the above-noted circumstances. It is an object of the present invention to provide a combustion powered nail gun, which has a safety mechanism that can prevent an accident firing in the event of unintentional pressing of the trigger switch.

To attain the above object, the present invention provides a combustion powered nail gun comprises a housing, a combustion sleeve, a trigger switch, a safety lever, a security member and a restriction member. The combustion sleeve is mounted in the housing and reciprocally moveable between a sealed position where a combustion chamber is defined therein, and an open position. The trigger switch is disposed in the housing and provided with a first hook portion. The safety lever is pivotally mounted in the housing and provided with a second hook portion biasable between a locked position where the second hook portion is engaged with the first hook portion of the trigger switch, and a released position where the second hook portion is spaced away from the first hook portion of the trigger switch. The security member has a workpiece contact member and a linkage slidably mounted in the housing, connected with the combustion sleeve and provided with an end extending out of the housing and connected with the workpiece contact member. The restriction member is connected to and moveable along with the combustion sleeve in a way that when the combustion sleeve is in the open position, the restriction member blocks the safety lever to prohibit a pivotal movement of the safety lever for holding the second hook portion of the safety lever at the locked position so as to lock the trigger switch, and when the combustion sleeve is in the sealed position, the restriction member is spaced away from the safety lever to enable the second hook portion of the safety lever to be biased to the released position so as to unlock the trigger switch.

Another object of the present invention is to provide a combustion powered nail gun, which can prohibit firing when the number of the nails loaded in the nail magazine is lower than a predetermined value.

To achieve the above-mentioned object, the combustion powered nail gun may comprise a nail pushing member that is reciprocally moveable in a nail magazine that is mounted to and communicated with the housing and provided with a stop portion, which is stoppable at an end of the safety lever opposite to the second hook portion for prohibiting the pivotal movement of the safety lever so as to hold the safety lever at the locked position when a few numbers of the nails are left in the nail magazine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
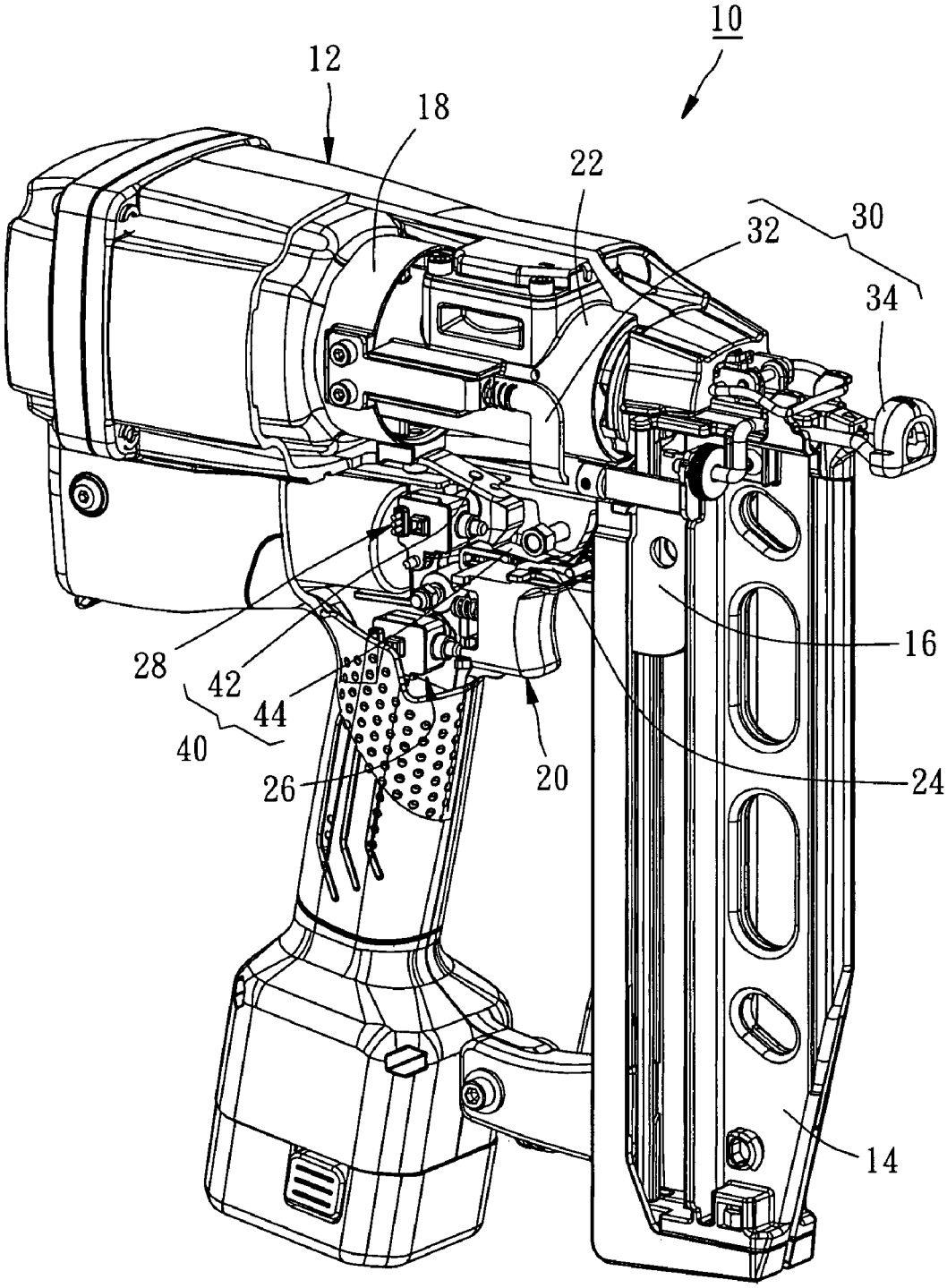
FIG. 1 is a perspective and partially cutaway view of a combustion powered nail gun in accordance with a first preferred embodiment of the present invention.

As shown in the FIGS. 1-6, the combustion powered nail gun, denoted by reference numeral 10, mainly comprises a housing 12, a nail magazine 14, a nail pushing member 16, a combustion sleeve 18, a trigger switch 20, a cylinder 22, a safety lever 24, a security member 30 and a restriction member 40.

The nail magazine 14 is connected to and communicated with a front end portion of the housing 12 for accommodating nails 15 therein.

The nail pushing member 16 is reciprocally moveably mounted in the nail magazine 14 and supported by a spring member, which is installed in the nail magazine 14 and not shown in the drawings, in such a way that the nail pushing member 16 can resiliently push the nails 15 one by one to a pre-firing position. When the nails 15 in the nail magazine 14 are ejected out of the housing 12 one after another, the nail pushing member 16 will upwardly move step by step due to the support of the aforesaid spring member. The nail pushing member 16 has a protruded stop portion 162 at a lateral side thereof.

The combustion sleeve 18 is mounted in the housing 12 and reciprocally slidable between a sealed position, where a combustion chamber (not shown) is formed and sealed therein, and an open position, where the combustion chamber is opened. Specifically specking, when the combustion sleeve 18 is in the sealed position, the combustion sleeve 18 and the rear portion of the cylinder 22 combinationally form the combustion chamber 182, in which pressurized fuel gas and air can be mixed and ignited.

The trigger switch 20 is disposed at the housing 12 and pressable by an external force to activate an ignition switch 26 that is mounted inside the housing 12 behind the trigger switch 20 so as to ignite the mixture of pressurized fuel gas and air in the combustion chamber 182. The trigger switch 20 is provided at a front top end thereof with a first hook portion 202.

The cylinder 22, on which the combustion sleeve 18 is reciprocally slidable between the sealed and the open positions, is mounted in the housing 12. Inside the cylinder 22, a piston (not shown) and a driver blade 221, which has an end fixedly connected to a center of the piston, are slidably mounted, such that the ignited mixture will forcedly push the piston and the driver blade 221 to move forwardly for enabling the driver blade 221 to strike on the nail 15 in the pre-firing position so as to eject the nail out of the housing 12.

Figure 2:
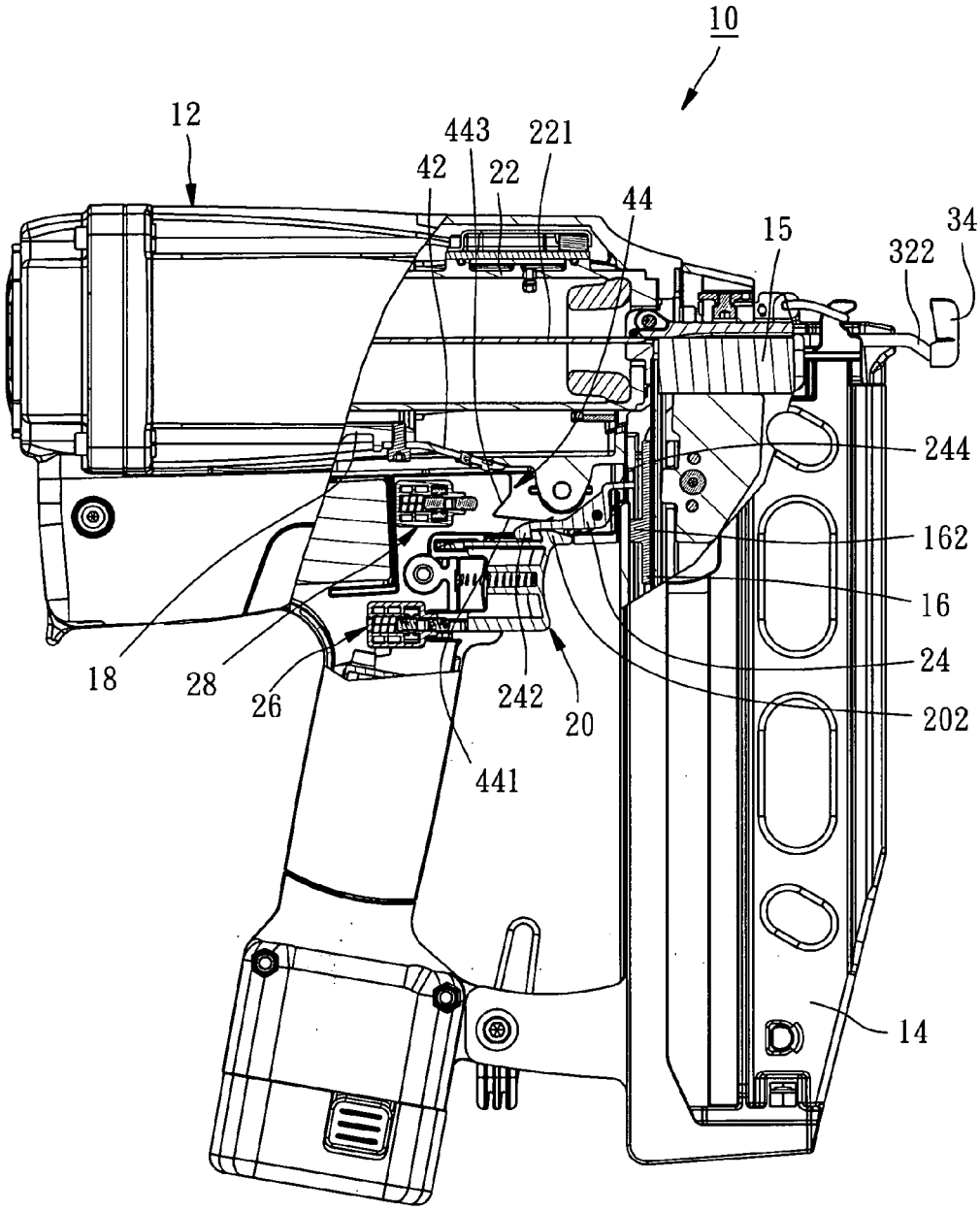
FIG. 2 is a front and partially cutaway view of the combustion powered nail gun in accordance with the first preferred embodiment of the present invention, showing that the combustion sleeve is in the open position.
Figure 3:
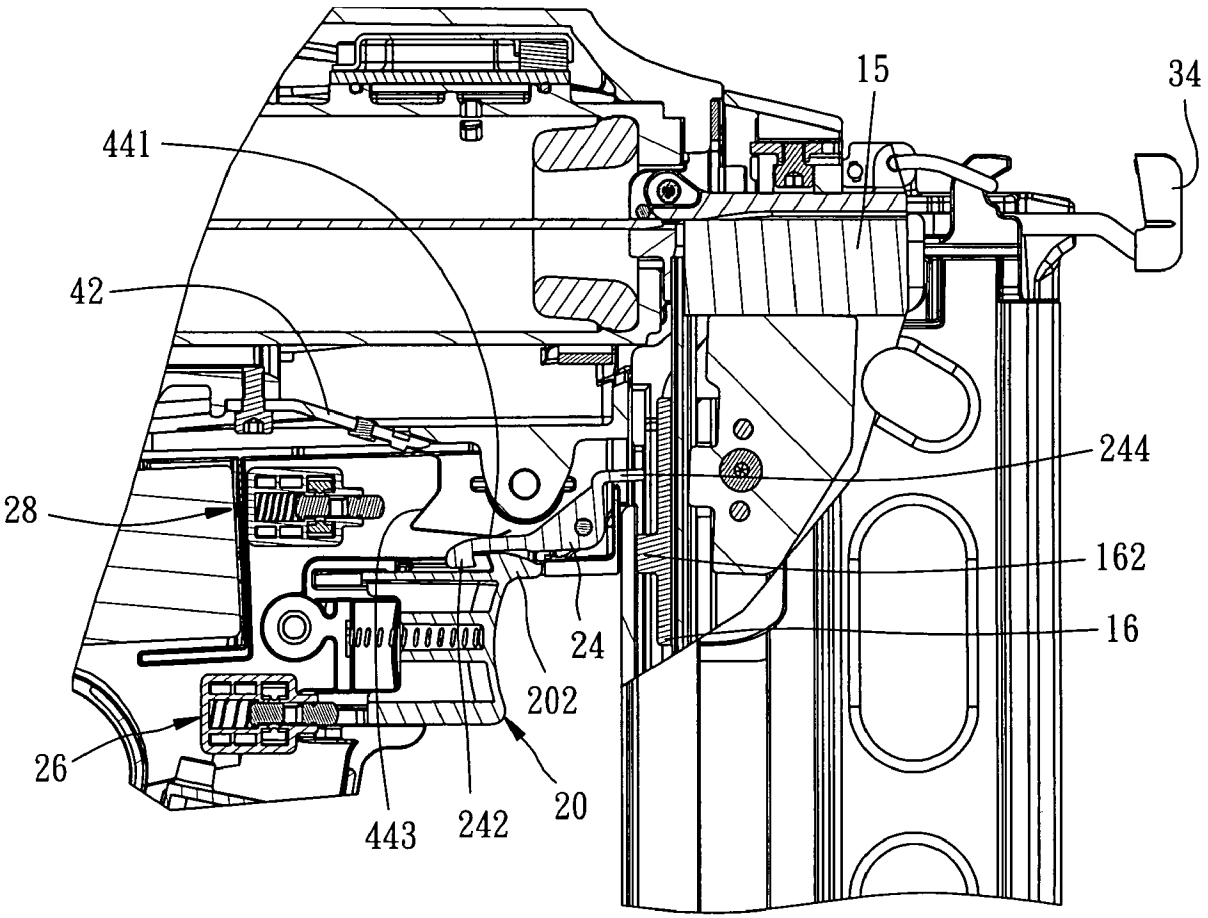
FIG. 3 is an enlarged view of a part of FIG. 2.
Figure 4:
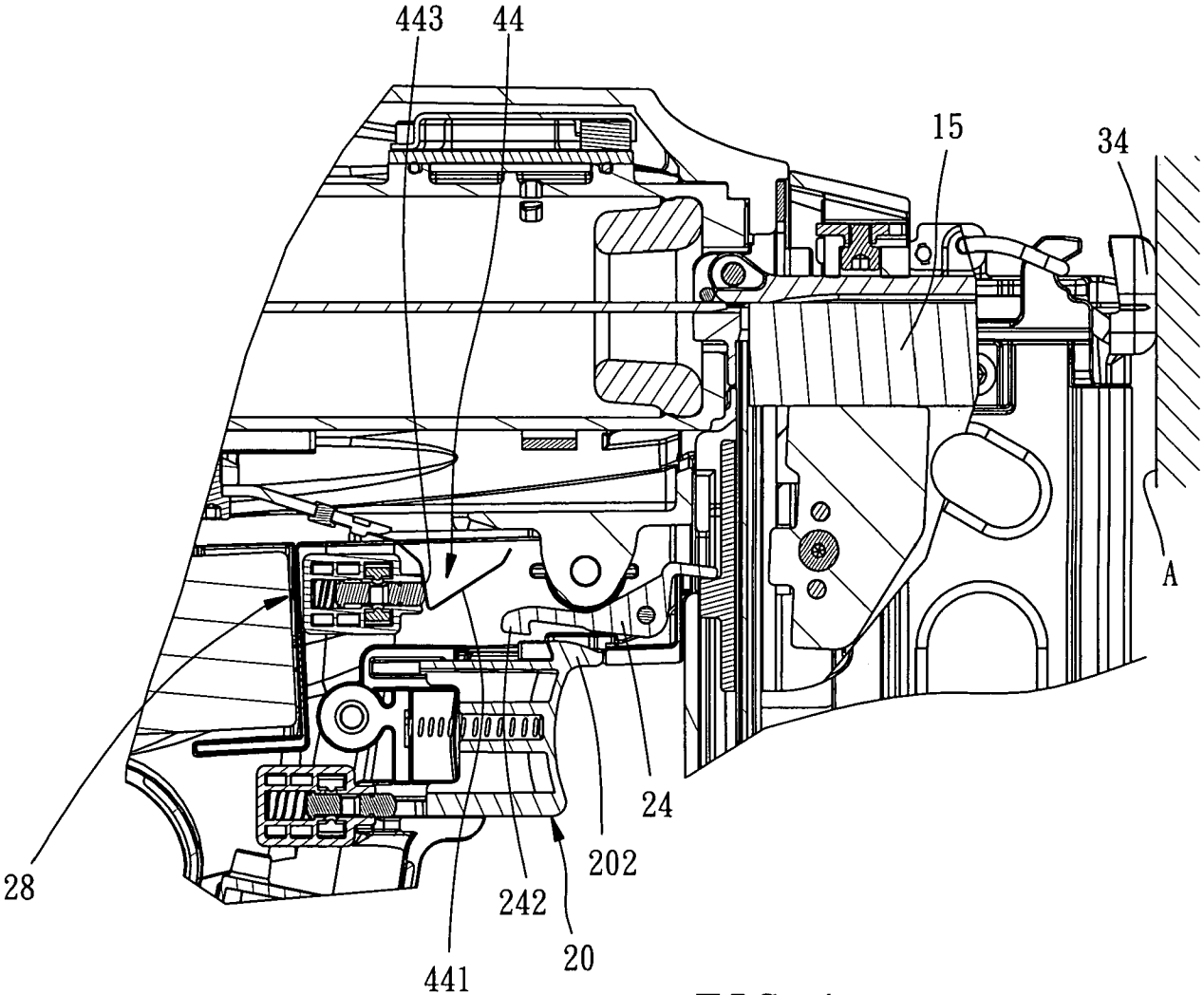
FIG. 4 is a sectional view of a part of the combustion powered nail gun in accordance with the first preferred embodiment of the present invention, showing that the combustion sleeve is in the sealed position and the trigger switch is not pressed.

The safety lever 24 is pivotally mounted in the housing 12 and has a first end provided with a second hook portion 242, which is biasable between a locked position where the second hook portion 242 is engaged with the first hook portion 202 of the trigger switch 20, as shown in FIGS. 1-3, and a released position where the second hook portion 242 is disengaged from the first hook portion 202 of the trigger switch 20, as shown in FIG. 4, and a second end 244 opposite to the second hook portion 242. A torsion spring (not shown) is mounted on the pivotal portion of the safety lever 24 and exerts an elastic rebound force tending to move the second hook portion 242 towards the released position, such that in a normal situation where no external force acts on the safety lever 24, the safety lever 24 will be supported by the torsion spring at the released position. In addition, when the nail pushing member 16 moves upwardly in the nail magazine 14 to a predetermined position, the stop portion 162 of the nail pushing member 16 will stop at the second end 244 of the safety lever 24 to prohibit the pivotal movement of the safety lever 24.

The security member 30 has a reciprocally moveable linkage 32 mounted in the housing 12, and a workpiece contact member 34. The reciprocally moveable linkage 32 has an end connected with the combustion sleeve 18 such that the combustion sleeve 18 is moveable backward and forward along with the reciprocal movement of the linkage 32, and a connection end 322 extending, through the nail magazine 14, out of the housing 12 and connected with the workpiece contact member 34. When the workpiece contact member 34 is not contacted and pressed by any object, for example a workpiece, the linkage 32 is motionless, resulting in that the combustion sleeve 18 is also motionless and stays at the open position, as shown in FIGS. 1-3. When the workpiece contact member 34 pressed on an object, as shown in FIG. 4, the linkage 34 will retract backward and at the same time, the combustion sleeve 18 will synchronously move backward to the sealed position in which the combustion chamber is formed and sealed and ready to be ignited.

The restriction member 40 is realized in this preferred embodiment by using a connection bar 42 and a resilient piece 44. A top end of the connection bar 42 is fixedly connection with the combustion sleeve 18 and a bottom end of the connection bar 42 is connected with the resilient piece 44, such that the restriction member 40 is synchronously moveable along with the combustion sleeve 18. The resilient piece 44 has a first stop portion 441 at its bottom portion and a second stop portion 443 at a bent, middle section thereof. When the workpiece contact member 34 is not pressed on any object, i.e. the combustion sleeve 18 stays at the open position, as shown in FIG. 2, the first stop portion 441 of the resilient piece 44 blocks the safety lever 24, such that the second hook portion 242 of the safety lever 24 is engaged with the first hook portion 202 of the trigger switch 20. At this stage, the trigger switch 20 is locked and not pressable. When the workpiece contact member 34 pressed on an object, the combustion sleeve 18 is moved to the sealed position, as shown in FIG. 4, the first stop portion 441 of the resilient piece 44 is moved along with the combustion sleeve 18 away from the safety lever 24, and as soon as the first stop portion 441 leaves the safety lever 24 the second hook portion 242 of the safety lever 24 is biased by the rebound force of the aforesaid torsion spring to the released position where the second hook portion 242 is separated from the first hook portion 202, resulting in that the trigger switch 20 is unlocked and pressable. At the same time, the second stop portion 443 of the resilient piece 44 will press on a fan switch 28 to activate fans (not shown) for mixing the pressurized fuel gas and air in the combustion chamber.

Figure 5:
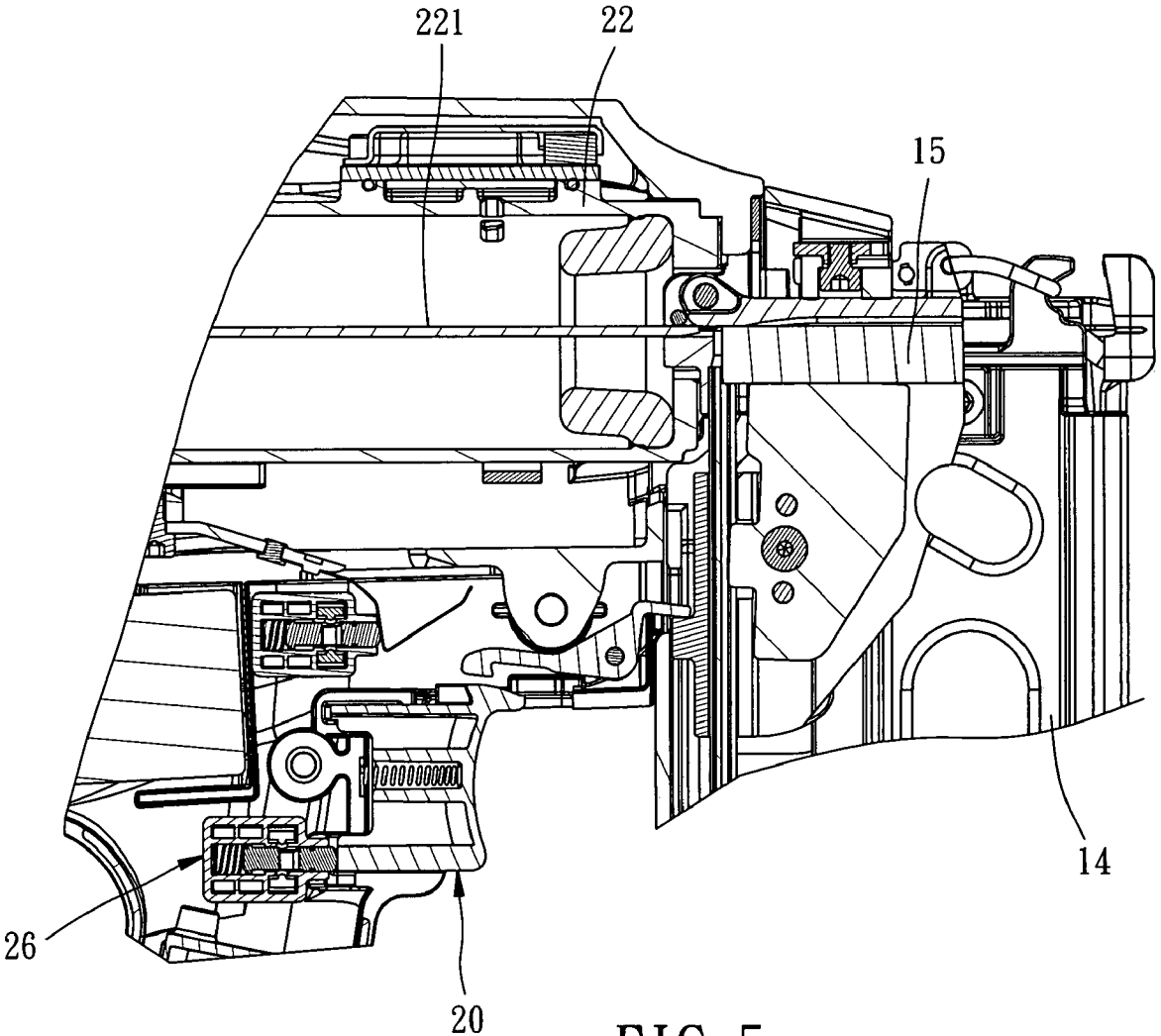
FIG. 5 is a sectional view of a part of the combustion powered nail gun in accordance with the first preferred embodiment of the present invention, but showing that the combustion sleeve is in the sealed position and the trigger switch is pressed.

As described above, when the combustion powered nail gun 10 is not in use, the second hook portion 242 of the safety lever 24 is pressed by the first stop portion 441 of the resilient piece 44 of the restriction member 40 and forcedly engaged with the first hook portion 202 of the trigger switch 20, resulting in that the trigger switch 20 is locked and the nail gun 10 can not be fired. As shown in FIG. 4, when the workpiece contact element 34 contacts and presses on the surface of an object A, the combustion sleeve 18 is moved along with the retraction motion of the linkage 32 to the sealed position to enable the pivotal movement of the safety lever 24 due to the separation of the first stop portion 441 of the resilient piece 44 from the safety lever 24 so as to separate the second hook portion 242 of the safety lever 24 from the first hook portion 202, and at the same time, the second stop portion 443 of the resilient piece 44 will press on the fan switch 28 to activate the fans for allowing the pressurized fuel gas and air to be mixed in the combustion chamber defined in the combustion sleeve 18. Thereafter, if the user presses the trigger switch 20, as shown in FIG. 5, the trigger switch 20 will press on an ignition switch 26 set behind the trigger switch 20 to ignite the mixture in the combustion chamber. As a result, the exploded high-speed gas will drive, through the piston in the cylinder 22, the driver blade 221 to move forwardly and rapidly, and then strike on the nail 15 at the pre-firing position, and eventually eject the nail 15 out of the housing 12.

Figure 6:
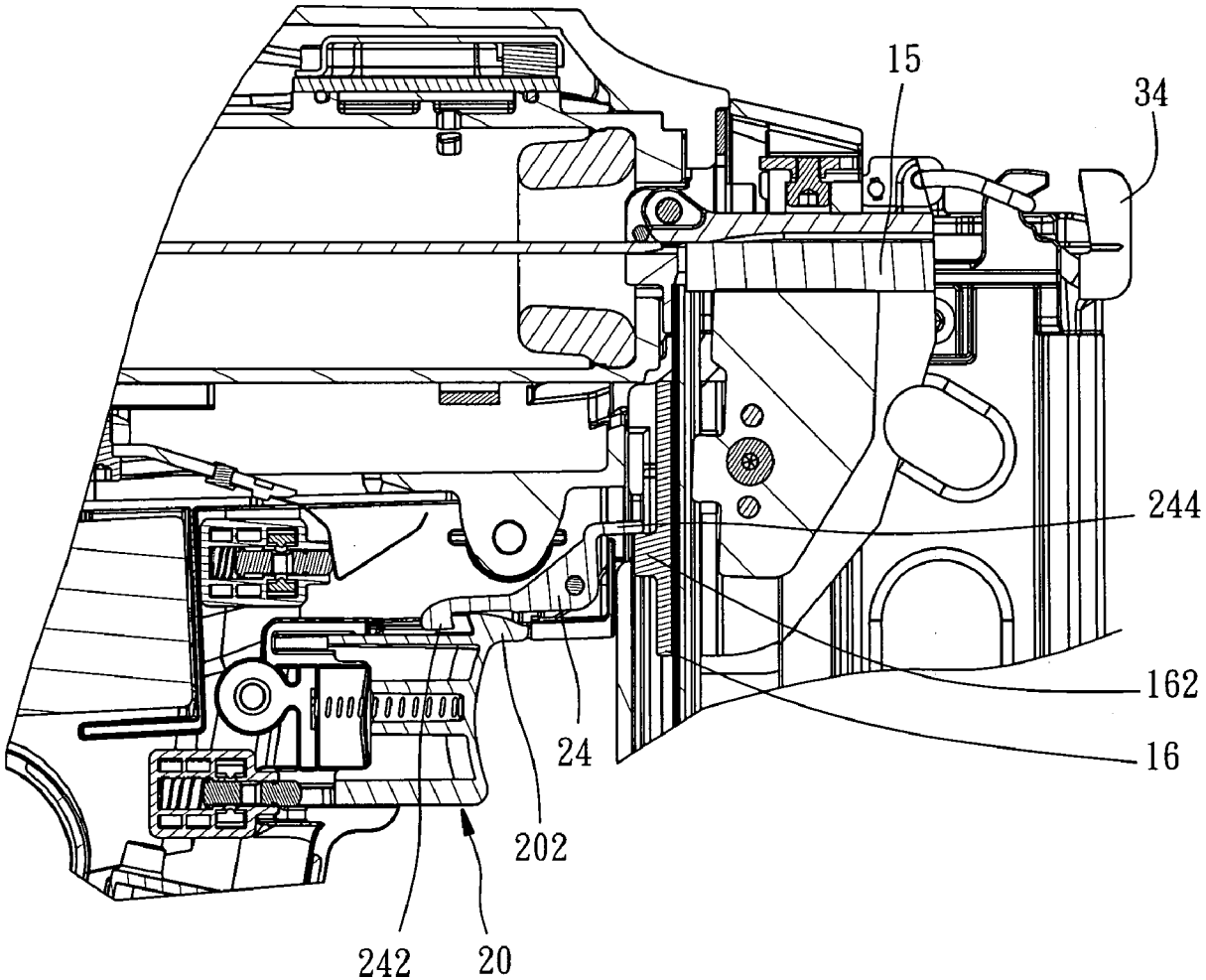
FIG. 6 is a sectional view of a part of the combustion powered nail gun in accordance with the first preferred embodiment of the present invention, showing that a nail pushing member is stopped at an end of the safety lever.

Accompanying with the continuous shooting of the combustion powered nail gun 10, the number of the nails 15 in the nail magazine 14 will become less and less and the nail pushing member 16 will move upwardly step by step. When the number of the nails 15 in the nail magazine 14 decreases to a predetermined value, for example, but not limited to, five nails left in the nail magazine 14, the stop portion 162 of the nail pushing member 16 will push the second end 244 of the safety lever 24 and drive the safety lever 24 to rotate counterclockwise, resulting in that the second hook portion 242 of the lever 24 is biased back to the locked position and engaged again with the first hook portion 202 of the trigger switch 20 so as to lock the trigger switch 20, as shown in FIG. 6. At this stage, even if the workpiece contact member 34 is pressed by an object to drive the combustion sleeve 18 to the sealed position, the combustion powered nail gun 10 can not be fired because the trigger switch 20 is locked, unless a sufficient number of nails are reloaded into the nail magazine 14 to forcedly move the nail pushing member 16 downwardly away from the second end 244 of the safety lever 24. This design prevents the combustion powered nail gun 10 of the present invention from being fired when the nail magazine 14 is empty so as to further avoid unnecessary damage of the internal elements due to firing without nail.

Figure 7:
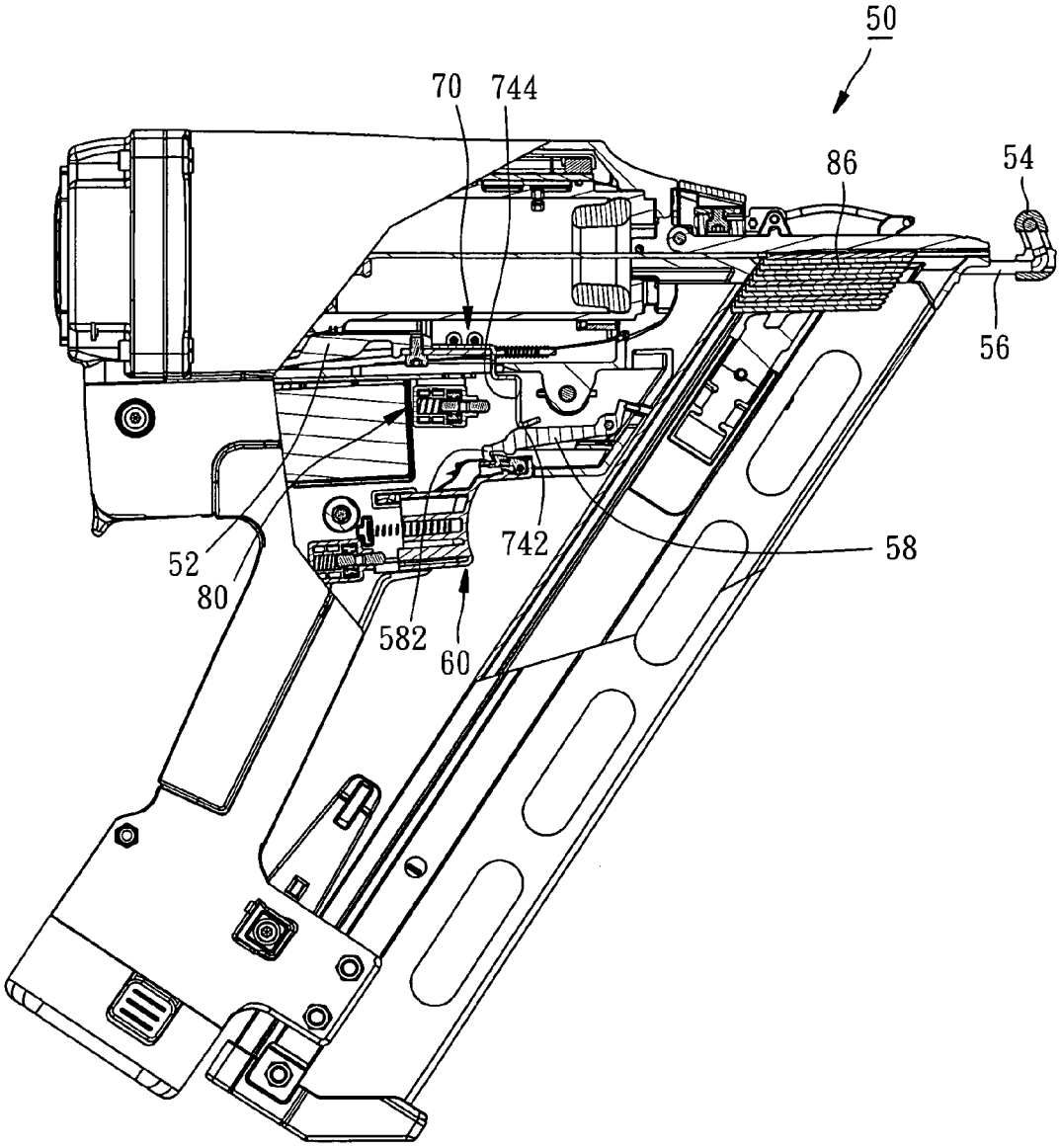
FIG. 7 is a perspective and partially cutaway view of a combustion powered nail gun in accordance with a second preferred embodiment of the present invention, showing that the combustion sleeve is in the open position.
Figure 8:
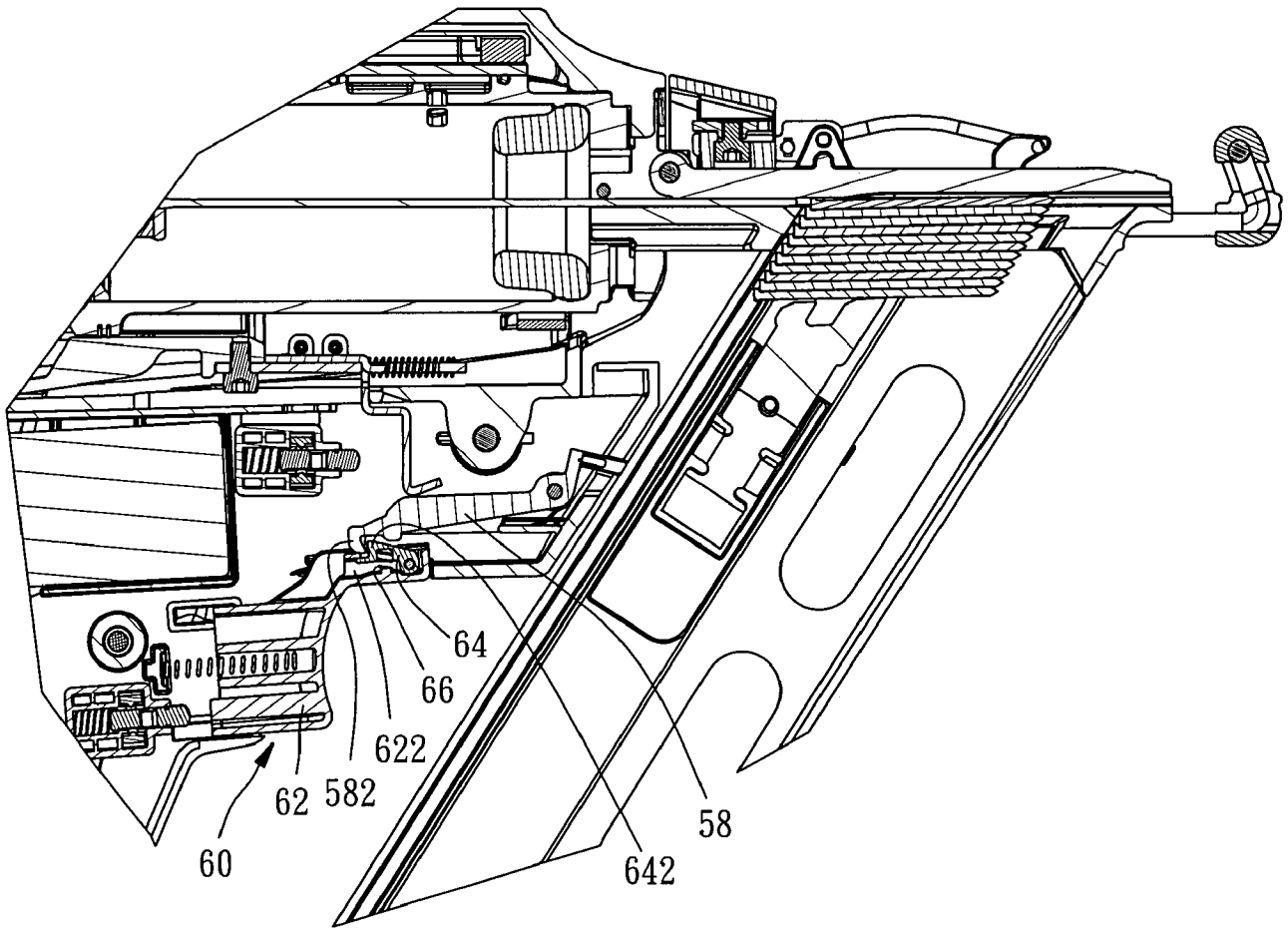
FIG. 8 is an enlarged view of a part of FIG. 7.

FIG. 7 shows a combustion powered nail gun, denoted with reference numeral 50, in accordance with a second preferred embodiment of the present invention. Most of the elements used in the first preferred embodiment are commonly used in this second preferred embodiment, and the differences between the first and second preferred embodiments will be outlined hereunder.

Referring to FIGS. 7-11, in this preferred embodiment, the trigger switch 60 comprises a moveable button 62, a hook 64 having a first hook portion 642, and a spring member 66. The moveable button 62 is provided at the top side thereof with a groove 622 in which the hook 64 is pivotally disposed. Two ends of the spring member 66 are respectively supported at the hook 64 and the periphery all defining the groove 622. In addition, the restriction member 70 comprises a connection bar 72 connected with the combustion sleeve 52, an urging member 74 having a first stop portion 742 at a bottom portion thereof and a second stop portion 744 at a middle section thereof, and a spring member 76 disposed on the urging member 74.

Figure 9:
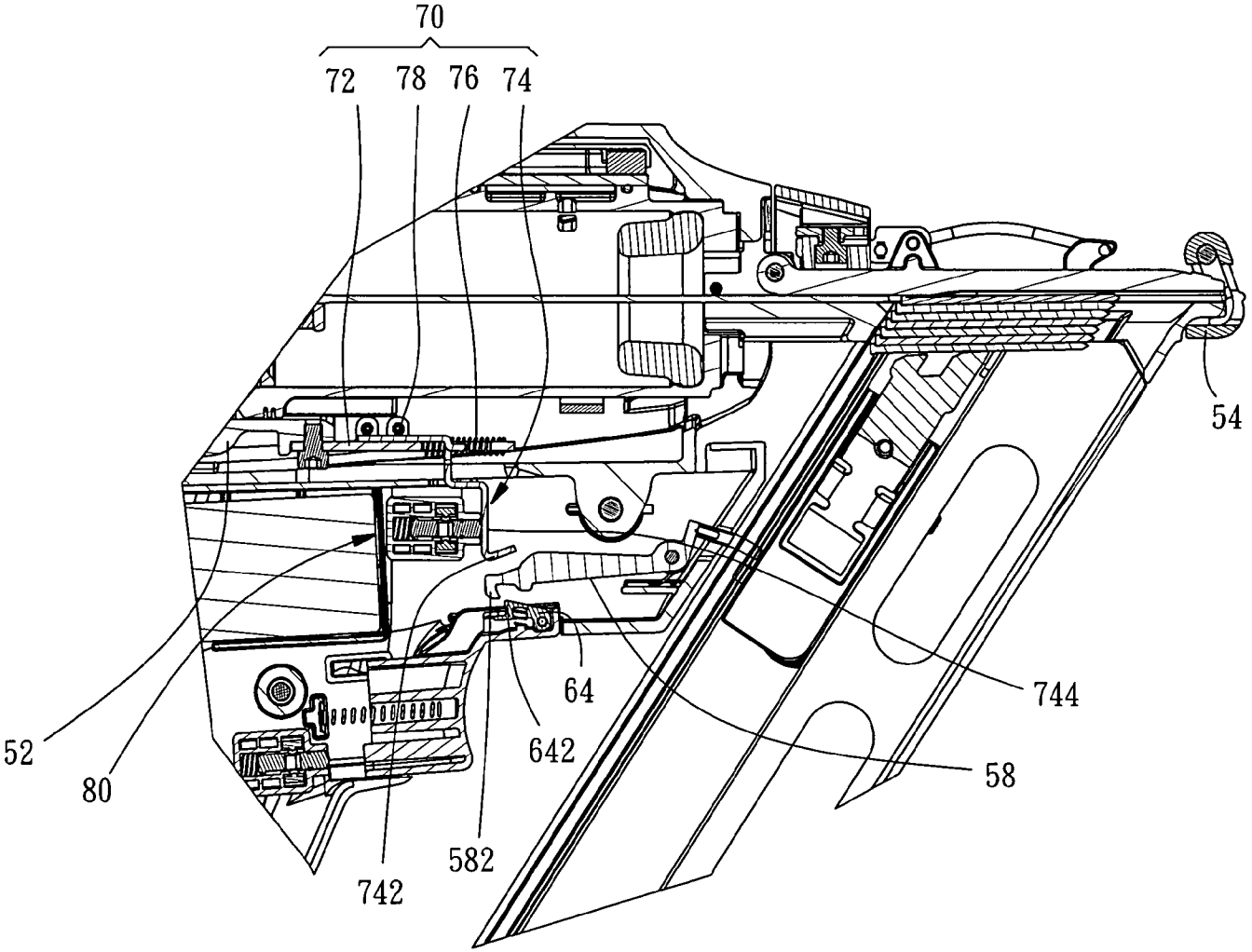
FIG. 9 is a sectional view of a part of the combustion powered nail gun in accordance with the second preferred embodiment of the present invention, showing that the combustion sleeve is in the sealed position and the trigger switch is not pressed.
Figure 10:
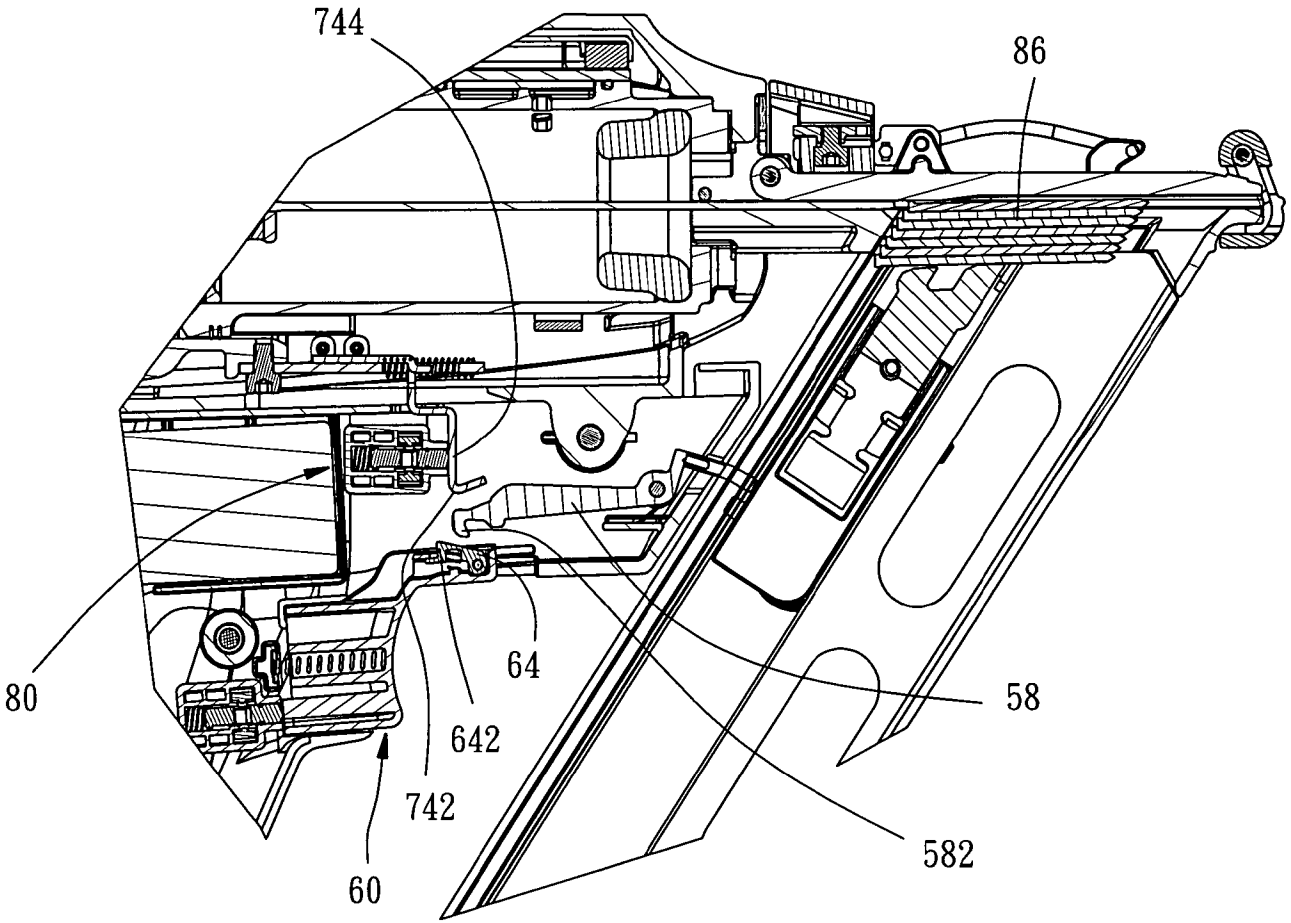
FIG. 10 is a sectional view of a part of the combustion powered nail gun in accordance with the second preferred embodiment of the present invention, but showing that the combustion sleeve is in the sealed position and the trigger switch is pressed.

As shown in FIG. 9, when the workpiece contact element 54 contacts and presses on the surface of an object, which causes that the combustion sleeve 52 is moved to the sealed position, the first stop portion 742 of the urging member 74 will separate from the safety lever 58 and then the second hook portion 582 of the safety lever 58 will be biased upwardly and disengaged from the first hook portion 642 of the hook 64, and at the same time, the second stop portion 744 of the urging member 74 will activate the fan switch 80 to rotate the fans (not shown). Thereafter, the user can press the trigger switch 60, as shown in FIG. 10, to complete the firing of the nail 86.

Figure 11:
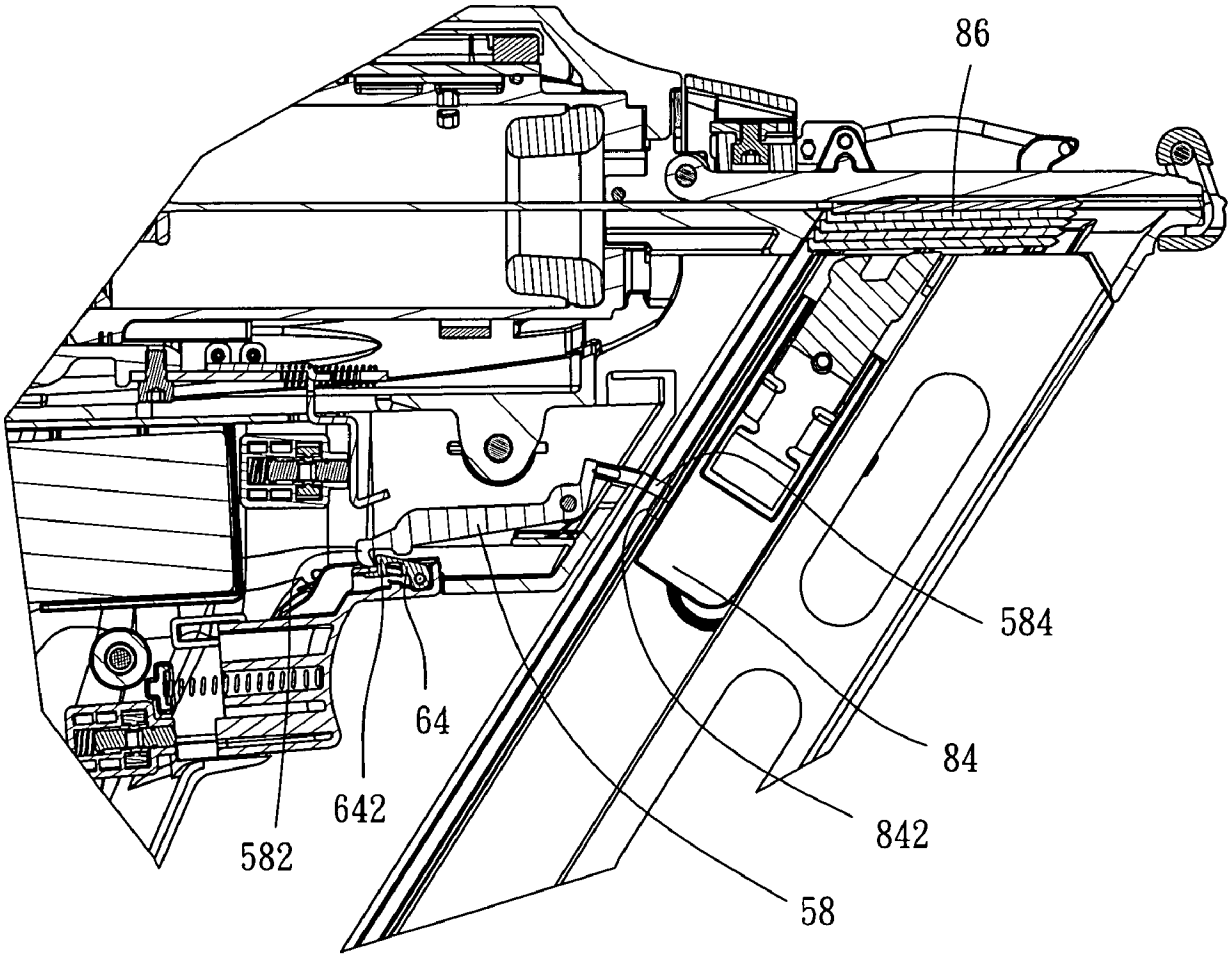
FIG. 11 is a sectional view of a part of the combustion powered nail gun in accordance with the second preferred embodiment of the present invention, showing that a nail pushing member is stopped at an end of the safety lever.

When the number of the nails 86 in the nail magazine decreases to a predetermined value, for example five or zero, the stop portion 842 of the nail pushing member 84 will push the second end 584 of the safety lever 58 and drive the safety lever 58 to rotate counterclockwise, resulting in that the second hook portion 584 of the safety lever 58 is biased back and engaged again with the first hook portion 642 of the hook 64, as shown in FIG. 11, to lock the trigger switch 60 so as to prevent the nail gun 50 from firing in the condition of lack of nails 86 in the nail magazine.

It is to be mentioned that the urging member 74 is reciprocally slidable in a range defined by the connection bar 72 and the rivet 78 inserted through the connection bar 72, and the spring member 76 can absorb the over stroke of the urging member 74 under the operation process of the workpiece contact member 54. Usually, the stroke of the workpiece contact member 54 is set in a range of 3-5 mm. The urging member 74 is a rigid body, which may damage the fan switch 80 when the second stop portion 744 of the urging member 74 impacts the fan switch 80. To prevent such damage, the stroke of the workpiece contact member 54 exceeding 3 mm will be buffered by the spring member 76 according to the design of this preferred embodiment.

Figure 12:
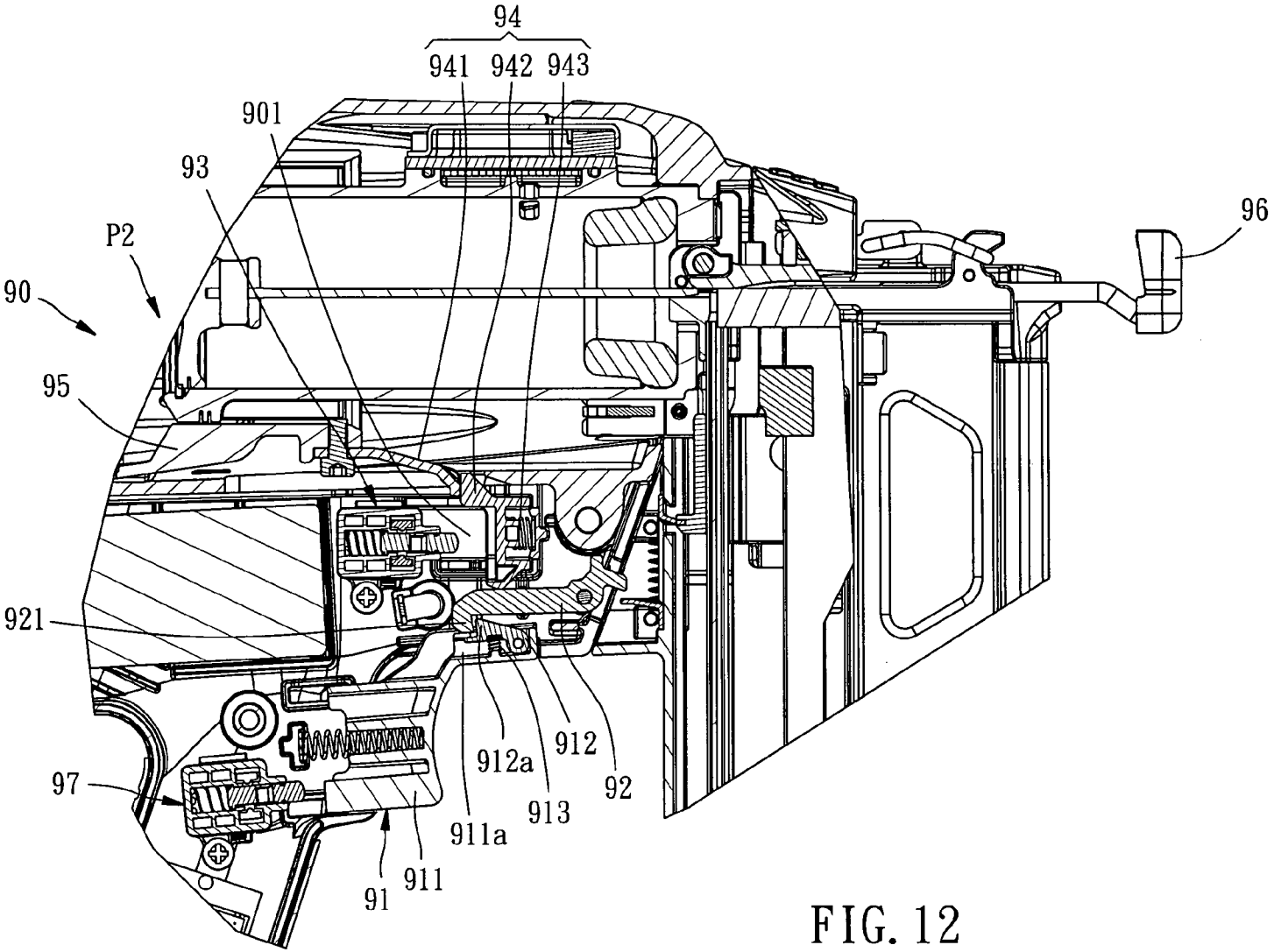
FIG. 12 is a sectional view of a part of a combustion powered nail gun in accordance with a third preferred embodiment of the present invention, showing that the combustion sleeve is in the open position.
Figure 13:
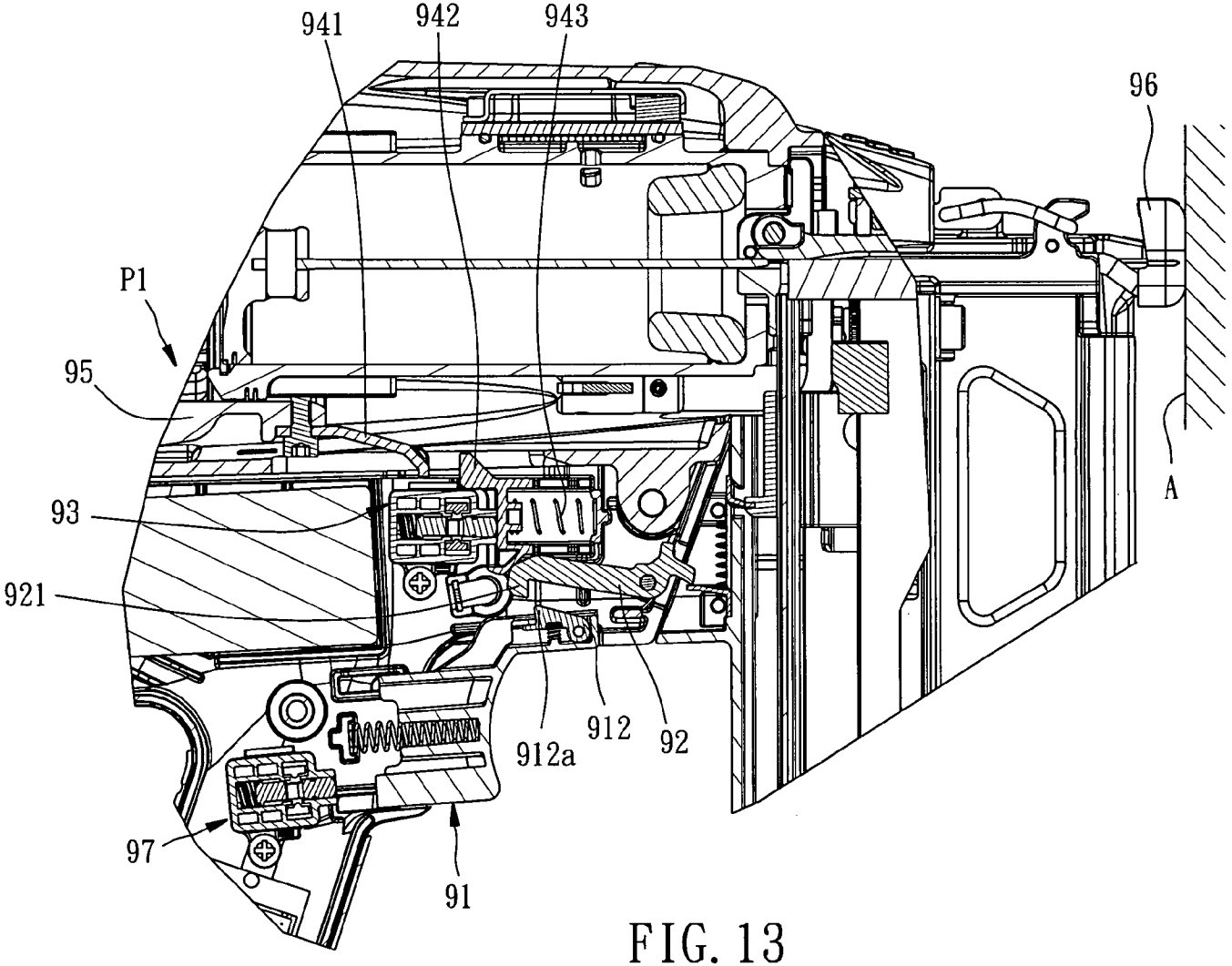
FIG. 13 is a sectional view of a part of the combustion powered nail gun in accordance with the third preferred embodiment of the present invention, showing that the combustion sleeve is in the sealed position and the trigger switch is not pressed.

FIGS. 12-13 show a part of a combustion powered nail gun, denoted with reference numeral 90, in accordance with a third preferred embodiment of the present invention. The trigger switch 91 of the nail gun 90 is similar to that of the above-mentioned second preferred embodiment. Specifically speaking, the trigger switch 91 comprises a moveable button 911 having a groove 911*a*, a hook 912 having a first hook portion 912*a*, and a spring member 913. The safety lever 92 in this preferred embodiment is configured to be similar to that of the second preferred embodiment mentioned above, having a second hook portion 921. The differences between the nail gun 90 of this preferred embodiment and the nail gun 50 of the second preferred embodiment are outlined hereinafter.

The combustion powered nail gun 90 has an accommodation 901 near to the fan switch 93, and the restriction member 94 includes a connection bar 941, a push block 942 and a spring member 943.

The connection bar 941 is a rigid body and connected with the combustion sleeve 95. The push block 942 is disposed in the accommodation 901 and reciprocally moveable between a first position P1 where the push block 942 presses on the fan switch 93, as shown in FIG. 13, and a second position P2 where the push block 942 is spaced away from the fan switch 93, as shown in FIG. 12. The spring member 943 is mounted in the accommodation 901 and exerts an elastic rebound force on the push block 942 tending to move the push block 942 towards the first position P1.

In case the workpiece contact member 96 of the nail gun 90 is not pressed such that the combustion sleeve 95 is kept in the open position, as shown in FIG. 12, the push block 942 will be stopped by an end of the connection bar 941 at the second position P2. At this moment, the spring member 943 is compressed and the push block 942 has a bottom protrusion stopping against the safety lever 92 to make the second hook portion 921 be engaged with the first hook portion 912*a* of the hook 912 of the trigger switch 91. In this way, the trigger switch 91 is locked and not pressable to make sure that the ignition switch 97 will not be activated accidentally.

When the workpiece contact element 96 pressed on an object A, the combustion sleeve 95 is changed in its position to the sealed position, as shown in FIG. 13, the push block 942, which is no longer stopped by the connection bar 941, will be moved by the spring member 943 to the first position P1 where the push block 942 presses on the fan switch 93 and is spaced away from the safety lever 92, and at the same time, the safety lever 92 will be biased clockwise by a torsion spring (not shown) to make its second hook portion 921 be disengaged from the first hook portion 912*a* of the hook 912 of the trigger switch 91. Under this circumstance, the trigger switch 91 is unlocked and becomes pressable for activating the ignition switch 97 for firing the nail.

As described above, an accident firing of the nail due to an unintentional pressing of the trigger switch can be effectively prevented by means of the cooperation of the restriction member and the safety lever, thereby enhancing the safety of use of the combustion powered nail gun. In addition, the cooperation of the stop portion of the nail pushing member and the second end of the safety lever can effectively prevent the combustion powered nail gun from firing in a nail-empty condition so as to further protect the internal elements of the nail gun from damage that could be caused by the firing in the lack of nails in the nail magazine. It will be appreciated that the predetermined number of the nails that are left in the nail magazine, which is preset as a threshold to trigger the aforesaid protection mechanism, can be set in any value according to the actual need, not limited to the value mentioned in the above embodiments.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A combustion powered nail gun, comprising:

a housing;

a combustion sleeve mounted in the housing and reciprocally moveable between a sealed position where a combustion chamber is defined therein, and an open position;

a trigger switch disposed in the housing and provided with a first hook portion;

a safety lever pivotally mounted in the housing and provided with a second hook portion biasable between a locked position where the second hook portion is engaged with the first hook portion of the trigger switch, and a released position where the second hook portion is spaced away from the first hook portion of the trigger switch;

a security member having a workpiece contact member and a linkage slidably mounted in the housing, connected with the combustion sleeve and provided with an end extending out of the housing and connected with the workpiece contact member; and a restriction member connected to and moveable along with the combustion sleeve in a way that when the combustion sleeve is in the open position, the restriction member blocks the safety lever to prohibit a pivotal movement of the safety lever for holding the second hook portion of the safety lever at the locked position so as to lock the trigger switch, and when the combustion sleeve is in the sealed position, the restriction member is spaced away from the safety lever to enable the second hook portion of the safety lever to be biased to the released position so as to unlock the trigger switch; and a fan switch and an ignition switch respectively mounted in the housing; wherein when the combustion sleeve is moved to the sealed position, the restriction member is moved away from the safety lever and activates the fan switch, and the trigger switch is pressable to activate the ignition switch.

2. The combustion powered nail gun as claimed in claim 1, wherein the restriction member comprises a connection bar connected with the combustion sleeve, and a resilient piece connected with the connection bar and provided with a first stop portion and a second stop portion; when the combustion sleeve is in the open position, the first stop portion of the resilient piece is blocked the safety lever and the second stop portion of the resilient piece is spaced away from the fan switch; when the combustion sleeve is in the sealed position, the first stop portion of the resilient piece is spaced away from the safety lever and the second stop portion of the resilient piece presses on the fan switch.

3. The combustion powered nail gun as claimed in claim 1, wherein the restriction member comprises a first stop portion and a second stop portion; when the combustion sleeve is in the open position, the first stop portion of the restriction member is blocked the safety lever and the second stop portion of the restriction member is spaced away from the fan switch; when the combustion sleeve is in the sealed position, the first stop portion of the restriction member is spaced away from the safety lever and the second stop portion of the restriction member presses on the fan switch.

4. The combustion powered nail gun as claimed in claim 1, wherein the trigger switch comprises a moveable button mounted in the housing and having a groove, a hook pivotally disposed in the groove and having said first hook portion, and a spring member supported between the moveable button and the hook.

5. The combustion powered nail gun as claimed in claim 1, further comprising a nail magazine mounted to and communicated with the housing, and a nail pushing member that is reciprocally moveable in the nail magazine and provided with a stop portion that is stoppable, when the nail pushing member is moved to a predetermined position in the nail magazine, at an end of the safety lever opposite to the second hook portion for prohibiting the pivotal movement of the safety lever.

6. The combustion powered nail gun as claimed in claim 1, wherein the restriction member comprises a connection bar connected with the combustion sleeve, and a push block reciprocally moveable between a first position where the push block presses on the fan switch and is spaced away from the safety lever to enable the second hook portion of the safety lever to be biasable to the released position, and a second position where the push block is spaced away from the fan switch and stopped at the safety lever to keep the second hook portion of the safety lever in the locked position; when the combustion sleeve is in the open position, the push block is stopped by the connection bar at the second position so as to lock the trigger switch; when the combustion sleeve is in the sealed position, the connection bar is spaced away from the push block to enable the push block to move to the first position so as to unlock the trigger switch.

7. The combustion powered nail gun as claimed in claim 6, wherein the trigger switch comprises a moveable button mounted in the housing and having a groove, a hook pivotally disposed in the groove and having said first hook portion, and a spring member supported between the moveable button and the hook.

8. The combustion powered nail gun as claimed in claim 6, wherein the housing comprises an accommodation for receiving the push block; the restriction member further comprises a spring member exerting an elastic rebound force on the push block tending to move the push block towards the first position.

* * * * *